US011646478B2

(12) United States Patent
Zhu et al.

(10) Patent No.: US 11,646,478 B2
(45) Date of Patent: May 9, 2023

(54) META-SURFACE WATER LOAD

(71) Applicant: Sichuan University, Sichuan (CN)

(72) Inventors: Huacheng Zhu, Sichuan (CN); Yang Yang, Sichuan (CN)

(73) Assignee: Sichuan University, Sichuan (CN)

( * ) Notice: Subject to any disclaimer, the term of this patent is extended or adjusted under 35 U.S.C. 154(b) by 139 days.

(21) Appl. No.: 17/356,525

(22) Filed: Jun. 24, 2021

(65) Prior Publication Data

US 2021/0328318 A1 Oct. 21, 2021

Related U.S. Application Data

(63) Continuation of application No. PCT/CN2021/080943, filed on Mar. 16, 2021.

(51) Int. Cl.
*H01P 1/26* (2006.01)
*H01P 1/30* (2006.01)
*H01P 3/16* (2006.01)

(52) U.S. Cl.
CPC ..... *H01P 1/30* (2013.01); *H01P 1/262* (2013.01); *H01P 1/264* (2013.01); *H01P 3/16* (2013.01)

(58) Field of Classification Search
CPC ..... H01P 1/30; H01P 1/24; H01P 1/26; H01P 1/262; H01P 1/264; H01P 1/22; H01P 1/222; H01P 1/207; H01P 3/16; H01P 3/00; H01P 3/12; H05K 7/20
See application file for complete search history.

(56) References Cited

U.S. PATENT DOCUMENTS 4,593,259 A * 6/1986 Fox ..... H01P 1/262 333/252
11,380,971 B2 * 7/2022 Johnson ..... H01P 1/264

OTHER PUBLICATIONS

Xu et al., Broadband asymmetric waveguiding of light without polarization limitations, Nature Communications, 2013.
Sun et al., Gradient-index meta-surfaces as a bridge linking propagating waves and surface waves, Nature Materials, 2012.
Mei et al., Gradient index metamaterials realized by drilling hole arrays, Journal of Physics D: Applied Physics, 2010, vol. 43.
Jason Valentine et al., An optical cloak made of dielectrics, Nature Materials, 2009, vol. 8, pp. 568-571.
Xu et al., Planar gradient metamaterials, Nature Reviews Materials, 2016, vol. 1.

* cited by examiner

*Primary Examiner* — Stephen E. Jones

(57) ABSTRACT

A meta-surface water load includes a waveguide section, a water load section and two meta-surface plates; the water load section is arranged at a rear end of the waveguide section; the two meta-surface plates are arranged opposite on inner walls of two narrow sides of the waveguide section; the water load section includes a metal casing, a ceramic partition, a water inlet and a water outlet; the metal casing is mounted at the rear end of the waveguide section; cooling liquid flows in the metal casing, entering from the water inlet and leaving from the water outlet; the ceramic partition is for separating interior of the waveguide section and interior of the metal casing; a relative permittivity of materials from front to rear of each meta-surface plate is progressively increased, so that microwave in the waveguide section is propagated to the water load section in one direction.

7 Claims, 1 Drawing Sheet

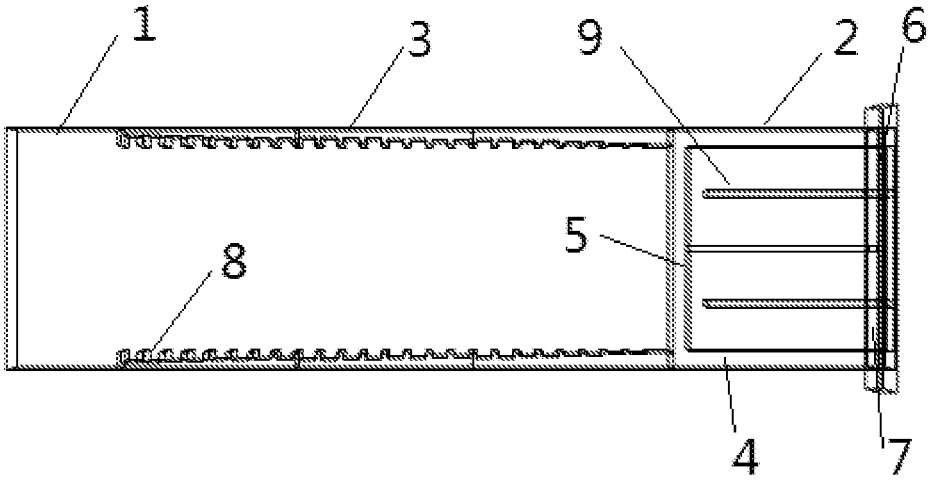
1
3
9
2
6
5
8
4
7

META-SURFACE WATER LOAD

CROSS REFERENCE OF RELATED APPLICATION

The application is a continuation application of a PCT application No. PCT/CN2021/080943, filed on Mar. 16, 2021; and claims the priority of Chinese Patent Application CN 202011423274.3, filed to the China National Intellectual Property Administration (CNIPA) on Dec. 8, 2020, the entire content of which are incorporated hereby by reference.

BACKGROUND OF THE PRESENT INVENTION

Field of Invention

The present invention relates to a technical field of microwave application, and more particularly to a meta-surface water load.

Description of Related Arts

In the industrial application of microwave energy, there exists more or less microwave reflection. Thus, it is necessary to arrange a load on the circulator to absorb the reflected microwave, thereby protecting the microwave source. The water load, as a common terminal matching load, comprises a waveguide transmission section and a microwave absorption cavity section, wherein: an interior of the absorption cavity is a water chamber where the cooling liquid flows; and a sealing ring is adopted for sealing the water chamber and the metal cavity. The microwave transmitted in the waveguide is absorbed by the cooling liquid flowing in the water chamber and converted into the thermal energy. The power absorbed by the load is larger, the temperature inside the absorption cavity is higher and the temperature rise of the cooling liquid is faster; therefore, the cooling liquid needs to keep the certain flow rate to meet the requirements of power capacity, otherwise the temperature of the water load will be too high and the absorption of the microwave will be poor. It is unable to meet the use requirements if the standing wave of the water load rapidly increases, so that the absorption cavity and the water chamber need to safely work under the water pressure of certain flow rate.

For the conventional water load, it is necessary to add pins for impedance matching. However, the change of the water temperature in the water load will cause the impedance mismatch, so that the absorptive effect on the microwave energy is weakened and the protection for the microwave source is weakened. The microwave power and the flow velocity of water will influence the absorptive capacity of the water load, resulting in the problem that the water load may not normally work when the cooling liquid is in a large range of flow velocity and temperature.

SUMMARY OF THE PRESENT INVENTION

Aiming at the above deficiencies, an object of the present invention is to provide a meta-surface water load, for solving problems such as how to keep high-efficient absorption of a water load to microwave energy when cooling liquid is in a large range of flow velocity and temperature. In order to accomplish the above object, the present invention adopts technical solutions as follows.

A meta-surface water load comprises a waveguide section, a water load section and two meta-surface plates, wherein: the water load section is arranged at a rear end of the waveguide section; the two meta-surface plates are arranged opposite on inner walls of two narrow sides of the waveguide section; the water load section comprises a metal casing, a ceramic partition, a water inlet and a water outlet; the metal casing is mounted at the rear end of the waveguide section; cooling liquid flows in the metal casing, entering from the water inlet and leaving from the water outlet; the ceramic partition is for separating interior of the waveguide section and interior of the metal casing; a relative permittivity of materials from front to rear of each meta-surface plate is progressively increased, so that microwave in the waveguide section is propagated to the water load section in one direction. It can be seen from the above structure that: the reflected microwave enters the water load section from the waveguide section; because the two meta-surface plates are arranged opposite on the inner walls of the two narrow sides of the waveguide section, the microwave can only be propagated to the water load section in one direction and cannot return back to the microwave source. The cooling liquid flows in the metal casing, entering from the water inlet and leaving from the water outlet, for high-efficiently absorbing the reflected microwave energy. Owing to the special structure of the meta-surface plates, the microwave can only enter the water load and cannot leave, so that less reflected microwave returns back to the microwave source, for protecting the microwave source. The meta-surface plates increase the absorptivity of the microwave energy, so that the microwave energy can be high-efficiently absorbed and utilized. Owing to the own characteristic of the meta-surface plates, the microwave can only be propagated in one direction, so the microwave is completely absorbed. The reason why the microwave can only enter the water load and cannot leave is that the relative permittivity of the materials from front to rear of each meta-surface plate is progressively increased; the progressive increase can be continuous and smooth, or can be stepped; that is to say, the relative permittivity of the material at the foremost end of each meta-surface plate is smallest, while the relative permittivity of the material at the rearmost end of each meta-surface plate is largest, so that the microwave can only be propagated in one direction when passing through the waveguide section provided with the meta-surface plates and will not escape. Therefore, the pins can be canceled, and the impedance matching of the water load is not required; even though the dielectric property of the cooling liquid changes due to the large power and high temperature, the microwave absorptive capacity will not reduce. The meta-surface water load provided by the present invention is applicable to the power capacity of large range; even though the temperature change of the cooling liquid is large, owing to the one-direction microwave propagation characteristic of the meta-surface plates, the water load can keep the high-efficient absorption to the microwave energy.

Preferably, for each meta-surface plate, in a length direction, a coordinate of a starting point away from the water load section is $x_0$, and a coordinate of an ending point close to the water load section is $x_L$; a relative permittivity of every position point of the meta-surface plate in the length direction constitutes a step function, and a coordinate of the position point is x, $x_L>x>x_0$; each step of the step function intersects with another built theoretical function of $$\varepsilon'(x) = n^2(x) = \left[1 + \frac{K(x - x_0)}{2k_0 d}\right]^2;$$

wherein: in the equation, $\varepsilon'(x)$ represents a theoretical function of relative permittivity changing with a position; $n(x)$ represents a theoretical function of refractive index changing with the position; K is a constant, whose value determines a change rate of the refractive index and a change rate of the relative permittivity and can be obtained through electromagnetic simulation optimization; $k_0$ represents a wave number of an electromagnetic wave; and d represents a thickness of the meta-surface plate. It can be seen from the above structure that: in the existing theory, the electromagnetic wave will generate a phase change when meeting the meta-surface plate, and the phase change is continuous in the direction of meta-surface; after passing through the meta-surface plate multiple times, the electromagnetic wave is gradually changed into a surface wave, so that one-direction transmission of the electromagnetic wave is realized. A distribution of the electromagnetic wave on the meta-surface plate is as follows. A TE (Transverse Electric) wave satisfies $$\nabla \times \left(\frac{1}{\mu_0 \mu(x)} \nabla \times \vec{E}\right) = \omega^2 \varepsilon_0 \varepsilon(x) \vec{E},$$

wherein: in the equation, $\vec{E}$ represents an electric field strength; $\varepsilon_0$ represents a vacuum permittivity; $\mu_0$ represents a vacuum permeability; $\omega$ represents an angular frequency of the electromagnetic wave; x represents a coordinate of the meta-surface plate relative to a starting position, namely a position of one point in the waveguide; x at the starting position of the meta-surface plate is 0, in unit of m; $\varepsilon(x)$ represents a permittivity at the x position of the meta-surface plate; and $\mu(x)$ represents a permeability of a graded index meta-surface at the x position. Through weakening the meta-surface plate in a certain way and sacrificing part of the functions of the meta-surface plate, a capacitance tensor of the meta-surface plate is ensured to be equivalent to a permeability tensor; weakening and sacrificing part of the functions of the meta-surface plate means sacrificing the change of the permeability with the position, and the continuous change of the permittivity with the position is weakened to the discrete change of the permittivity with the position; the permittivity function of the materials of the weakened meta-surface plate is $$\varepsilon'(x) = n^2(x) = \left[1 + \frac{K(x - x_0)}{2k_0 d}\right]^2,$$

that is to say the relative permittivity of every position point of the meta-surface plate in the length direction is different. However, the above structure is actually difficult to be realized. According to the present invention, the change of the relative permittivity of every position point of the meta-surface plate in the length direction is stepped, not continuous; the step function of the stepped change approaches the function of $$\varepsilon'(x) = n^2(x) = \left[1 + \frac{K(x - x_0)}{2k_0 d}\right]^2,$$

so that the meta-surface plate whose relative permittivity of the materials from front to rear is progressively increased is formed. For example, at a portion of the meta-surface plate, with the coordinate of $x_1$-$x_2$, the same relative permittivity of $[\varepsilon'(x_1)+\varepsilon'(x_2)]/2$ is adopted; in the coordinate system, the horizontal coordinate is $x_1$-$x_2$, and the vertical coordinate is a horizontal segment of $[\varepsilon'(x_1)+\varepsilon'(x_2)]/2$; the segment intersects with the function of $$\varepsilon'(x) = n^2(x) = \left[1 + \frac{K(x - x_0)}{2k_0 d}\right]^2,$$

that is to say the segment is one step of the step function.

Preferably, each meta-surface plate comprises a plurality of dielectric plates which are sequentially arranged from front to rear; a relative permittivity of a front dielectric plate is smaller than that of a rear dielectric plate; a function segment, constituted by the relative permittivity of every position point of one dielectric plate, corresponds to one step of the step function. It can be seen from the above structure that: the relative permittivity of the dielectric plate at one position corresponds to one step of the step function. The relative permittivity of the front dielectric plate is smaller than that of the rear dielectric plate; each meta-surface plate, whose relative permittivity of the materials from front to rear is progressively increased, adopts a plurality of dielectric plates which are sequentially arranged from front to rear, which facilitates processing of the meta-surface plate and the calculation and experimental verification with the existing theory.

Preferably, slots are provided on each dielectric plate, penetrating through a top part and a bottom part of each dielectric plate. It can be seen from the above structure that: through the slots which are provided on each dielectric plate and penetrate through the top part and the bottom part of each dielectric plate, the relative permittivity of each dielectric plate can be changed.

Preferably, a section of the slots provided on the front dielectric plate is larger than that of the slots provided on the rear dielectric plate. It can be seen from the above structure that: the section of the slots provided on the dielectric plate is larger, the relative permittivity of the dielectric plate is smaller; the section of the slots provided on the dielectric plate is smaller, the relative permittivity of the dielectric plate is larger; the section of the slots provided on the dielectric plates from front to rear is smaller and smaller, and the relative permittivity of the materials from front to rear is progressively increased.

Preferably, a thickness of each meta-surface plate is 8 mm. It can be seen from the above structure that: the meta-surface plate with the thickness of 8 mm is convenient to process.

Preferably, a plurality of baffles, vertical to the ceramic partition, are arranged inside the metal casing; adjacent baffles are staggered, so that the cooling liquid flows in the metal casing in an S-shape. It can be seen from the above structure that: the adjacent baffles are staggered, so that the cooling liquid flows in the metal casing in the S-shape, which lengthens the absorption time of the cooling liquid to the microwave and improves the absorption efficiency of the cooling liquid to the microwave.

The present invention has beneficial effects as follows.

The present invention provides the meta-surface water load, relating to the technical field of microwave application. The meta-surface water load comprises the waveguide section, the water load section and two meta-surface plates; the water load section is arranged at the rear end of the waveguide section; the two meta-surface plates are arranged opposite on the inner walls of the two narrow sides of the waveguide section; the water load section comprises the metal casing, the ceramic partition, the water inlet and the water outlet; the metal casing is mounted at the rear end of the waveguide section; the cooling liquid flows in the metal casing, entering from the water inlet and leaving from the water outlet; the ceramic partition is for separating the interior of the waveguide section and the interior of the metal casing; the relative permittivity of the materials from front to rear of each meta-surface plate is progressively increased, so that the microwave in the waveguide section is propagated to the water load section in one direction. According to the meta-surface water load provided by the present invention, when the temperature of the cooling liquid rises, the high-efficient absorption of the cooling liquid to the microwave energy is still kept, so that the water load can normally work when the cooling liquid is in the large range of flow velocity and temperature.

BRIEF DESCRIPTION OF THE DRAWINGS

The FIGURE is a structural sketch view of a meta-surface water load according to present invention.

In the FIGURE: 1: waveguide section; 2: water load section; 3: meta-surface plate; 4: metal casing; 5: ceramic partition; 6: water inlet; 7: water outlet; 8: slot; and 9: baffle.

DETAILED DESCRIPTION OF THE PREFERRED EMBODIMENT

The present invention is further illustrated in detail with the accompanying drawing and the preferred embodiments as follows, but the present invention is not limited thereto.

First Preferred Embodiment

Referring to the FIGURE, according to the first preferred embodiment, a meta-surface water load comprises a waveguide section 1, a water load section 2 and two meta-surface plates 3, wherein: the water load section 2 is arranged at a rear end of the waveguide section 1; the two meta-surface plates 3 are arranged opposite on inner walls of two narrow sides of the waveguide section 1; the water load section 2 comprises a metal casing 4, a ceramic partition 5, a water inlet 6 and a water outlet 7; the metal casing 4 is mounted at the rear end of the waveguide section 1; cooling liquid flows in the metal casing 4, entering from the water inlet 6 and leaving from the water outlet 7; the ceramic partition 5 is for separating interior of the waveguide section 1 and interior of the metal casing 4; a relative permittivity of materials from front to rear of each meta-surface plate 3 is progressively increased, so that microwave in the waveguide section 1 is propagated to the water load section 2 in one direction. It can be seen from the above structure that: the reflected microwave enters the water load section 2 from the waveguide section 1; because the two meta-surface plates 3 are arranged opposite on the inner walls of the two narrow sides of the waveguide section 1, the microwave can only be propagated to the water load section 2 in one direction and cannot return back to the microwave source. The cooling liquid flows in the metal casing 4, entering from the water inlet 6 and leaving from the water outlet 7, for high-efficiently absorbing the reflected microwave energy. Owing to the special structure of the meta-surface plates 3, the microwave can only enter the water load and cannot leave, so that less reflected microwave returns back to the microwave source, for protecting the microwave source. The meta-surface plates 3 increase the absorptivity of the microwave energy, so that the microwave energy can be high-efficiently absorbed and utilized. Owing to the own characteristic of the meta-surface plates 3, the microwave can only be propagated in one direction, so the microwave is completely absorbed. The reason why the microwave can only enter the water load and cannot leave is that the relative permittivity of the materials from front to rear of each meta-surface plate 3 is progressively increased; the progressive increase can be continuous and smooth, or can be stepped; that is to say, the relative permittivity of the material at the foremost end of each meta-surface plate 3 is smallest, while the relative permittivity of the material at the rearmost end of each meta-surface plate 3 is largest, so that the microwave can only be propagated in one direction when passing through the waveguide section 1 provided with the meta-surface plates 3 and will not escape. Therefore, the pins can be canceled, and the impedance matching of the water load is not required; even though the dielectric property of the cooling liquid changes due to the large power and high temperature, the microwave absorptive capacity will not reduce. The meta-surface water load provided by the present invention is applicable to the power capacity of large range; even though the temperature change of the cooling liquid is large, owing to the one-direction microwave propagation characteristic of the meta-surface plates 3, the water load can keep the high-efficient absorption to the microwave energy.

Second Preferred Embodiment

Referring to the FIGURE, according to the second preferred embodiment, a meta-surface water load comprises a waveguide section 1, a water load section 2 and two meta-surface plates 3, wherein: the water load section 2 is arranged at a rear end of the waveguide section 1; the two meta-surface plates 3 are arranged opposite on inner walls of two narrow sides of the waveguide section 1; the water load section 2 comprises a metal casing 4, a ceramic partition 5, a water inlet 6 and a water outlet 7; the metal casing 4 is mounted at the rear end of the waveguide section 1; cooling liquid flows in the metal casing 4, entering from the water inlet 6 and leaving from the water outlet 7; the ceramic partition 5 is for separating interior of the waveguide section 1 and interior of the metal casing 4; a relative permittivity of materials from front to rear of each meta-surface plate 3 is progressively increased, so that microwave in the waveguide section 1 is propagated to the water load section 2 in one direction. It can be seen from the above structure that: the reflected microwave enters the water load section 2 from the waveguide section 1; because the two meta-surface plates 3 are arranged opposite on the inner walls of the two narrow sides of the waveguide section 1, the microwave can only be propagated to the water load section 2 in one direction and cannot return back to the microwave source. The cooling liquid flows in the metal casing 4, entering from the water inlet 6 and leaving from the water outlet 7, for high-efficiently absorbing the reflected microwave energy. Owing to the special structure of the meta-surface plates 3, the microwave can only enter the water load and cannot leave, so that less reflected microwave returns back to the microwave source, for protecting the microwave source. The meta-surface plates 3 increase the absorptivity of the microwave energy, so that the microwave energy can be high-efficiently absorbed and utilized. Owing to the own characteristic of the meta-surface plates 3, the microwave can only be propagated in one direction, so the microwave is completely absorbed. The reason why the microwave can only enter the water load and cannot leave is that the relative permittivity of the materials from front to rear of each meta-surface plate 3 is progressively increased; the progressive increase can be continuous and smooth, or can be stepped; that is to say, the relative permittivity of the material at the foremost end of each meta-surface plate 3 is smallest, while the relative permittivity of the material at the rearmost end of each meta-surface plate 3 is largest, so that the microwave can only be propagated in one direction when passing through the waveguide section 1 provided with the meta-surface plates 3 and will not escape. Therefore, the pins can be canceled, and the impedance matching of the water load is not required; even though the dielectric property of the cooling liquid changes due to the large power and high temperature, the microwave absorptive capacity will not reduce. The meta-surface water load provided by the present invention is applicable to the power capacity of large range; even though the temperature change of the cooling liquid is large, owing to the one-direction microwave propagation characteristic of the meta-surface plates 3, the water load can keep the high-efficient absorption to the microwave energy.

For each meta-surface plate 3, in a length direction, a coordinate of a starting point away from the water load section 2 is $x_0$, and a coordinate of an ending point close to the water load section 2 is $x_L$; a relative permittivity of every position point of the meta-surface plate 3 in the length direction constitutes a step function, and a coordinate of the position point is x, $x_L>x>x_0$; each step of the step function intersects with another built theoretical function of $$\varepsilon'(x) = n^2(x) = \left[1 + \frac{K(x - x_0)}{2k_0 d}\right]^2;$$

wherein: in the equation, ε'(x) represents a theoretical function of relative permittivity changing with a position; n(x) represents a theoretical function of refractive index changing with the position; K is a constant, whose value determines a change rate of the refractive index and a change rate of the relative permittivity and can be obtained through electromagnetic simulation optimization; $k_0$ represents a wave number of an electromagnetic wave; and d represents a thickness of the meta-surface plate 3. It can be seen from the above structure that: in the existing theory, the electromagnetic wave will generate a phase change when meeting the meta-surface plate 3, and the phase change is continuous in the direction of meta-surface; after passing through the meta-surface plate 3 multiple times, the electromagnetic wave is gradually changed into a surface wave, so that one-direction transmission of the electromagnetic wave is realized. A distribution of the electromagnetic wave on the meta-surface plate 3 is as follows. A TE (Transverse Electric) wave satisfies $$\nabla \times \left(\frac{1}{\mu_0 \mu(x)} \nabla \times \vec{E}\right) = \omega^2 \varepsilon_0 \varepsilon(x) \vec{E},$$

wherein: in the equation, $\vec{E}$ represents an electric field strength; $\varepsilon_0$ represents a vacuum permittivity; $\mu_0$ represents a vacuum permeability; ω represents an angular frequency of the electromagnetic wave; x represents a coordinate of the meta-surface plate 3 relative to a starting position, namely a position of one point in the waveguide; x at the starting position of the meta-surface plate 3 is 0, in unit of m; ε(x) represents a permittivity at the x position of the meta-surface plate 3; and μ(x) represents a permeability of a graded index meta-surface at the x position. Through weakening the meta-surface plate 3 in a certain way and sacrificing part of the functions of the meta-surface plate 3, a capacitance tensor of the meta-surface plate 3 is ensured to be equivalent to a permeability tensor; weakening and sacrificing part of the functions of the meta-surface plate 3 means sacrificing the change of the permeability with the position, and the continuous change of the permittivity with the position is weakened to the discrete change of the permittivity with the position; the permittivity function of the materials of the weakened meta-surface plate 3 is $$\varepsilon'(x) = n^2(x) = \left[1 + \frac{K(x - x_0)}{2k_0 d}\right]^2,$$

that is to say the relative permittivity of every position point of the meta-surface plate 3 in the length direction is different. However, the above structure is actually difficult to be realized. According to the present invention, the change of the relative permittivity of every position point of the meta-surface plate 3 in the length direction is stepped, not continuous; the step function of the stepped change approaches the function of $$\varepsilon'(x) = n^2(x) = \left[1 + \frac{K(x - x_0)}{2k_0 d}\right]^2,$$

so that the meta-surface plate 3 whose relative permittivity of the materials from front to rear is progressively increased is formed. For example, at a portion of the meta-surface plate 3, with the coordinate of $x_1$-$x_2$, the same relative permittivity of $[\varepsilon'(x_1)+\varepsilon'(x_2)]/2$ is adopted; in the coordinate system, the horizontal coordinate is $x_1$-$x_2$, and the vertical coordinate is a horizontal segment of $[\varepsilon'(x_1)+\varepsilon'(x_2)]/2$; the segment intersects with the function of $$\varepsilon'(x) = n^2(x) = \left[1 + \frac{K(x - x_0)}{2k_0 d}\right]^2,$$

that is to say the segment is one step of the step function.

Third Preferred Embodiment

Referring to the FIGURE, according to the third preferred embodiment, a meta-surface water load comprises a waveguide section 1, a water load section 2 and two meta-surface plates 3, wherein: the water load section 2 is arranged at a rear end of the waveguide section 1; the two meta-surface plates 3 are arranged opposite on inner walls of two narrow sides of the waveguide section 1; the water load section 2 comprises a metal casing 4, a ceramic partition 5, a water inlet 6 and a water outlet 7; the metal casing 4 is mounted at the rear end of the waveguide section 1; cooling liquid flows in the metal casing 4, entering from the water inlet 6 and leaving from the water outlet 7; the ceramic partition 5 is for separating interior of the waveguide section 1 and interior of the metal casing 4; a relative permittivity of materials from front to rear of each meta-surface plate 3 is progressively increased, so that microwave in the waveguide section 1 is propagated to the water load section 2 in one direction. It can be seen from the above structure that: the reflected microwave enters the water load section 2 from the waveguide section 1; because the two meta-surface plates 3 are arranged opposite on the inner walls of the two narrow sides of the waveguide section 1, the microwave can only be propagated to the water load section 2 in one direction and cannot return back to the microwave source. The cooling liquid flows in the metal casing 4, entering from the water inlet 6 and leaving from the water outlet 7, for high-efficiently absorbing the reflected microwave energy. Owing to the special structure of the meta-surface plates 3, the microwave can only enter the water load and cannot leave, so that less reflected microwave returns back to the microwave source, for protecting the microwave source. The meta-surface plates 3 increase the absorptivity of the microwave energy, so that the microwave energy can be high-efficiently absorbed and utilized. Owing to the own characteristic of the meta-surface plates 3, the microwave can only be propagated in one direction, so the microwave is completely absorbed. The reason why the microwave can only enter the water load and cannot leave is that the relative permittivity of the materials from front to rear of each meta-surface plate 3 is progressively increased; the progressive increase can be continuous and smooth, or can be stepped; that is to say, the relative permittivity of the material at the foremost end of each meta-surface plate 3 is smallest, while the relative permittivity of the material at the rearmost end of each meta-surface plate 3 is largest, so that the microwave can only be propagated in one direction when passing through the waveguide section 1 provided with the meta-surface plates 3 and will not escape. Therefore, the pins can be canceled, and the impedance matching of the water load is not required; even though the dielectric property of the cooling liquid changes due to the large power and high temperature, the microwave absorptive capacity will not reduce. The meta-surface water load provided by the present invention is applicable to the power capacity of large range; even though the temperature change of the cooling liquid is large, owing to the one-direction microwave propagation characteristic of the meta-surface plates 3, the water load can keep the high-efficient absorption to the microwave energy.

For each meta-surface plate 3, in a length direction, a coordinate of a starting point away from the water load section 2 is $x_0$, and a coordinate of an ending point close to the water load section 2 is $x_L$; a relative permittivity of every position point of the meta-surface plate 3 in the length direction constitutes a step function, and a coordinate of the position point is x, $x_L>x>x_0$; each step of the step function intersects with another built theoretical function of $$\varepsilon'(x) = n^2(x) = \left[1 + \frac{K(x - x_0)}{2k_0 d}\right]^2;$$

wherein: in the equation, ε'(x) represents a theoretical function of relative permittivity changing with a position; n(x) represents a theoretical function of refractive index changing with the position; K is a constant, whose value determines a change rate of the refractive index and a change rate of the relative permittivity and can be obtained through electromagnetic simulation optimization; $k_0$ represents a wave number of an electromagnetic wave; and d represents a thickness of the meta-surface plate 3. It can be seen from the above structure that: in the existing theory, the electromagnetic wave will generate a phase change when meeting the meta-surface plate 3, and the phase change is continuous in the direction of meta-surface; after passing through the meta-surface plate 3 multiple times, the electromagnetic wave is gradually changed into a surface wave, so that one-direction transmission of the electromagnetic wave is realized. A distribution of the electromagnetic wave on the meta-surface plate 3 is as follows. A TE (Transverse Electric) wave satisfies $$\nabla \times \left(\frac{1}{\mu_0 \mu(x)} \nabla \times \vec{E}\right) = \omega^2 \varepsilon_0 \varepsilon(x) \vec{E},$$

wherein: in the equation, $\vec{E}$ represents an electric field strength; $\varepsilon_0$ represents a vacuum permittivity; $\mu_0$ represents a vacuum permeability; ω represents an angular frequency of the electromagnetic wave; x represents a coordinate of the meta-surface plate 3 relative to a starting position, namely a position of one point in the waveguide; x at the starting position of the meta-surface plate 3 is 0, in unit of m; ε(x) represents a permittivity at the x position of the meta-surface plate 3; and μ(x) represents a permeability of a graded index meta-surface at the x position. Through weakening the meta-surface plate 3 in a certain way and sacrificing part of the functions of the meta-surface plate 3, a capacitance tensor of the meta-surface plate 3 is ensured to be equivalent to a permeability tensor; weakening and sacrificing part of the functions of the meta-surface plate 3 means sacrificing the change of the permeability with the position, and the continuous change of the permittivity with the position is weakened to the discrete change of the permittivity with the position; the permittivity function of the materials of the weakened meta-surface plate 3 is $$\varepsilon'(x) = n^2(x) = \left[1 + \frac{K(x - x_0)}{2k_0 d}\right]^2,$$

that is to say the relative permittivity of every position point of the meta-surface plate 3 in the length direction is different. However, the above structure is actually difficult to be realized. According to the present invention, the change of the relative permittivity of every position point of the meta-surface plate 3 in the length direction is stepped, not continuous; the step function of the stepped change approaches the function of $$\varepsilon'(x) = n^2(x) = \left[1 + \frac{K(x - x_0)}{2k_0 d}\right]^2,$$

so that the meta-surface plate 3 whose relative permittivity of the materials from front to rear is progressively increased is formed. For example, at a portion of the meta-surface plate 3, with the coordinate of $x_1$-$x_2$, the same relative permittivity of $[\varepsilon'(x_1)+\varepsilon'(x_2)]/2$ is adopted; in the coordinate system, the horizontal coordinate is $x_1$-$x_2$, and the vertical coordinate is a horizontal segment of $[\varepsilon'(x_1)+\varepsilon'(x_2)]/2$; the segment intersects with the function of $$\varepsilon'(x) = n^2(x) = \left[1 + \frac{K(x - x_0)}{2k_0 d}\right]^2,$$

that is to say the segment is one step of the step function.

Each meta-surface plate 3 comprises a plurality of dielectric plates which are sequentially arranged from front to rear; a relative permittivity of a front dielectric plate is smaller than that of a rear dielectric plate; a function segment, constituted by the relative permittivity of every position point of one dielectric plate, corresponds to one step of the step function. It can be seen from the above structure that: the relative permittivity of the dielectric plate at one position corresponds to one step of the step function. The relative permittivity of the front dielectric plate is smaller than that of the rear dielectric plate; each meta-surface plate 3, whose relative permittivity of the materials from front to rear is progressively increased, adopts a plurality of dielectric plates which are sequentially arranged from front to rear, which facilitates processing of the meta-surface plate 3 and the calculation and experimental verification with the existing theory.

Slots 8 are provided on each dielectric plate, penetrating through a top part and a bottom part of each dielectric plate. It can be seen from the above structure that: through the slots 8 which are provided on each dielectric plate and penetrate through the top part and the bottom part of each dielectric plate, the relative permittivity of each dielectric plate can be changed.

A section of the slots 8 provided on the front dielectric plate is larger than that of the slots 8 provided on the rear dielectric plate. It can be seen from the above structure that: the section of the slots 8 provided on the dielectric plate is larger, the relative permittivity of the dielectric plate is smaller; the section of the slots 8 provided on the dielectric plate is smaller, the relative permittivity of the dielectric plate is larger; the section of the slots 8 provided on the dielectric plates from front to rear is smaller and smaller, and the relative permittivity of the materials from front to rear is progressively increased.

A thickness of each meta-surface plate 3 is 8 mm. It can be seen from the above structure that: the meta-surface plate 3 with the thickness of 8 mm is convenient to process.

A plurality of baffles 9, vertical to the ceramic partition 5, are arranged inside the metal casing 4; adjacent baffles 9 are staggered, so that the cooling liquid flows in the metal casing 4 in an S-shape. It can be seen from the above structure that: the adjacent baffles 9 are staggered, so that the cooling liquid flows in the metal casing 4 in the S-shape, which lengthens the absorption time of the cooling liquid to the microwave and improves the absorption efficiency of the cooling liquid to the microwave.

The above-described is only the preferred embodiments of the present invention, not for limiting the protection scope of the present invention. The equivalent structures or equivalent transformations made based on the specification and accompanying drawing of the present invention, or the direct or indirect applications in other related technical fields, are all encompassed in the protection scope of the present invention.

What is claimed is:

1. A meta-surface water load, comprising a waveguide section (1), a water load section (2) and two meta-surface plates (3), wherein: the water load section (2) is arranged at a rear end of the waveguide section (1); the two meta-surface plates (3) are arranged opposite on inner walls of two narrow sides of the waveguide section (1); the water load section (2) comprises a metal casing (4), a ceramic partition (5), a water inlet (6) and a water outlet (7); the metal casing (4) is mounted at the rear end of the waveguide section (1); cooling liquid flows in the metal casing (4), entering from the water inlet (6) and leaving from the water outlet (7); the ceramic partition (5) is for separating an interior of the waveguide section (1) and an interior of the metal casing (4); a relative permittivity of materials from front to rear of each meta-surface plate (3) is progressively increased, so that a microwave in the waveguide section (1) is propagated to the water load section (2) in one direction.

2. The meta-surface water load, as recited in claim 1, wherein: for each meta-surface plate (3), in a length direction, a coordinate of a starting point away from the water load section (2) is $x_0$, and a coordinate of an ending point close to the water load section (2) is $x_L$; a relative permittivity of every position point of the meta-surface plate (3) in the length direction constitutes a step function, and a coordinate of the position point is x, $x_L>x>x_0$; each step of the step function intersects with another built theoretical function of $$\varepsilon'(x) = n^2(x) = \left[1 + \frac{K(x - x_0)}{2k_0 d}\right]^2;$$

in the equation, ε'(x) represents a theoretical function of relative permittivity changing with a position; n(x) represents a theoretical function of refractive index changing with the position; K is a constant, whose value determines a change rate of the refractive index and a change rate of the relative permittivity and can be obtained through electromagnetic simulation optimization; $k_0$ represents a wave number of an electromagnetic wave; and d represents a thickness of the meta-surface plate (3).

3. The meta-surface water load, as recited in claim 2, wherein: each meta-surface plate (3) comprises a plurality of dielectric plates which are sequentially arranged from front to rear; a relative permittivity of a front dielectric plate is smaller than that of a rear dielectric plate; a function segment, constituted by the relative permittivity of every position point of one dielectric plate, corresponds to one step of the step function.

4. The meta-surface water load, as recited in claim 3, wherein: slots (8) are provided on each dielectric plate, penetrating through a top part and a bottom part of each dielectric plate.

5. The meta-surface water load, as recited in claim 4, wherein a section of the slots (8) provided on the front dielectric plate is larger than that of the slots (8) provided on the rear dielectric plate.

6. The meta-surface water load, as recited in claim 2, wherein a thickness of each meta-surface plate (3) is 8 mm.

7. The meta-surface water load, as recited in claim 1, wherein: a plurality of baffles (9), vertical to the ceramic partition (5), are arranged inside the metal casing (4); adjacent baffles (9) are staggered, so that the cooling liquid flows in the metal casing (4) in an S-shape.

* * * * *